United States Patent [19]

Wall

[11] 4,376,034

[45] Mar. 8, 1983

[54] METHOD AND APPARATUS FOR RECOVERING CARBON PRODUCTS FROM OIL SHALE

[76] Inventor: Edward T. Wall, 6055 S. Monaco Way, Englewood, Colo. 80111

[21] Appl. No.: 213,375

[22] Filed: Dec. 5, 1980

Related U.S. Application Data

[63] Continuation-in-part of Ser. No. 104,263, Dec. 17, 1979, abandoned.

[51] Int. Cl.[3] ..... C10G 1/00; C10B 1/04; B01D 3/00; C10B 19/00

[52] U.S. Cl. ..... 208/11 R; 208/8 R; 202/124; 202/234; 201/19; 264/25; 196/120

[58] Field of Search ..... 208/8 R, 11 R; 202/124, 202/234; 201/19; 264/25; 196/120; 166/248

[56] References Cited

U.S. PATENT DOCUMENTS

| | | | |
|---|---|---|---|
| 3,449,213 | 6/1969 | Knapp et al. | 201/19 |
| 3,560,347 | 2/1971 | Knapp et al. | 201/19 X |
| 4,065,361 | 12/1977 | Hanson | 201/19 X |
| 4,135,579 | 1/1979 | Rowland et al. | 166/248 |
| 4,140,179 | 2/1979 | Kasenich et al. | 166/248 |
| 4,153,533 | 5/1979 | Kirkbride | 201/19 X |

OTHER PUBLICATIONS

U. of Colo. College of Engineering and Applied Science:

Final Progress Report "A Study of the Use of Microwave Heating for the Release of Oil From OilShale", Sep. 1-Nov. 30, 1977, pp. 1-8.

"In Situ Noncombustive Microwave Processing of Oil Shale", Sep. 1-Dec. 31, 1978.

Annual Report, "In Situ Noncombustive Microwave Processing of Oil Shale", Aug. 31, 1979, pp. 1-12.

Progress Report, Jan. 1-Apr. 30, 1979, "In Situ Noncombustive Microwave Processing of Oil Shale", pp. 1-12.

"In Situ "Noncombustive Microwave Retorting of Oil Shale", A Proposal to the Dept. of Energy, pp. 1-38.

"A Study of the Use of Microwave Heating for the Release of Oil from Oil Shale", Annual Report, pp. 1-37, May 15, 1976-May 15, 1977.

"Preliminary Energy Balance and Economic Report on in situ and Modified In Situ Retorting of Oil Shale by Microwave Power", pp. 1-8.

"A Study of the Use of Microwave Heating for the Release of Oil from Oil Shale", Dec. 1976-1977, pp. 1-5.

"A Study of the Use of Microwave Heating for the Release of Oil from Oil Shale", pp. 1-10, May 1, 1977 to Aug. 31, 1977.

Supplement to Proposal by E. T. Wall, "In Situ Noncombustive Microwave Retorting of Oil Shale", pp. 1-3.

Revised Summary Documentation, "A Study of the Use of Microwave Heating for the Release of Oil from Oil Shale", Mar. 31, 1976, pp. 1-5.

A Proposal to N.S.F. (RANN), "Retorting and Physical Fracturing of Oil-Shale Ore by Means of Microwave Heating", 7/1/75, pp. 1-29.

"RF Technology Said to Offer Advantages in Shale Oil Recovery", Mering Engineering, p. 735.

"Radio Frequency Energy to get tryout in Mining Oil From Underground Shale", pp. 49-50, 3M Linda Lane, Jan. 3, 1980, Electronics.

*Primary Examiner*—Delbert E. Gantz
*Assistant Examiner*—William G. Wright
*Attorney, Agent, or Firm*—Ralph F. Crandell

[57] ABSTRACT

A method and apparatus for recovering and simultaneously partially refining hydrocarbon products such as liquid oil, oil vapor and combustible and noncombustible gases from oil shale, by subjecting the oil shale ore, in fragments between 5 and 10 cm, or larger, to microwave energy at frequencies between 300 MHz and 3000 MHz. The apparatus includes kiln structures closed to air and microwave leakage, and associated microwave generators for both continuous discrete and batch processes. The microwave energy may also be applied in situ to beds and deposits of the oil shale.

7 Claims, 5 Drawing Figures

METHOD AND APPARATUS FOR RECOVERING CARBON PRODUCTS FROM OIL SHALE

CROSS-REFERENCE TO RELATED APPLICATION

This application is a continuation-in-part of copending application Ser. No. 104,263, filed Dec. 17, 1979 now abandoned, for Method and Apparatus for Recovering Carbon Products from Hydrocarbon Fuel Precursors.

BACKGROUND OF THE INVENTION

1. Field of the Invention

The present invention relates to an improved method and apparatus for recovering and simultaneously partially refining hydrocarbon products, such as liquid oil, oil vapor and combustible and noncombustible gases, from oil shale. Valuable by-products such as sulfur and rare earth minerals and elements, are also recoverable by this method. More specifically, the invention relates to a method and apparatus for obtaining hydrocarbon products or fractions from oil shale, by the use of microwave energy.

2. Description of the Prior Art

Oil shale is commonly defined as organic-rich shale that can yield oil or gas upon heating. (T. F. Yen, "Science and Technology of Oil Shale", Ann Arbor Science Publishers, Ann Arbor, Mich.) Reference has been made in the art and published literature to the recovery of products from coal and oil shale by the use of microwave energy. It has been observed that certain organic solids, notably hydrocarbon fuel precursors such as coal and some similar substances, such as oil shale, can be destructively distilled by the application of microwave energy at high energy levels. R. F. Cane, *NATURE,* Jan. 8, 1966, pages 197, 198. As described by Cane, the organic matter was reduced to coke by the action of microwave energy. The microwave distillation and cracking of crude oil and shale oil, and the decomposition of coal and oil shales is mentioned in the ENCYCLOPEDIA OF CHEMICAL TECHNOLOGY, 1972 Supplement, at page 576. This latter reference also refers to Belgian Pat. No. 481,314 (1948). Studies on the pyrolysis of oil shale by microwave radiation heating have, subsequently, been reported by W. D. Stuckey, "A Study of the Pyrolysis of Oil Shale by Microwave Heating", M. S. Thesis, University of Colorado, Boulder, Colo., 1977. The results of further investigations and evaluations were reported in a technical paper by Chia-Lun J. Hu, "Online Measurements of the Fast Changing Dielectric Constant in Oil Shale due to High Power Microwave Heating", IEEE Transactions on Microwave Theory and Techniques, Vol. MIT-27, No. 1, Jan. 1979. The studies and investigations of Stuckey and Hu were supported in part by a National Science Foundation Grant (NSF Program-RANN No. AER 75-17453 awarded from May 15, 1976 to May 31, 1978 and subsequently extended to Aug. 31, 1979 by the United States Department of Energy).

Microwave power or energy refers to the wavelength or frequencies occupied in the electromagnetic spectrum. The domain occupied by the microwave frequencies in the electromagnetic spectrum is of arbitrary extent, between approximately $10^8$ and $10^{12}$ Hertz (cycles per second). This frequency interval thus adjoins the infrared frequency, which is usually considered to have a low-frequency limit of $10^{12}$ Hertz. The upper frequency limit of radio communication is of the order of $10^9$ Hertz. The propagation of wave energy in free space is of the order of $3\times10^8$ meters per second. Presently, typical and representative microwave power can be generated which has a frequency of between $0.915\times10^9$ and $2.45\times10^9$ Hertz. The wave lengths associated with these frequencies are, respectively, 0.328 meters and 0.122 meters, which are two of the four bands designated by the Federal Communications Commission (FCC) as the industrial, scientific and medical (ISM) frequency bands. If the FCC approves, lower frequencies such as those doen to $0.300\times10^9$ Hertz are included.

In a microwave heating system, the electrical energy input is converted to direct current and then applied to a high power microwave tube which generates the microwave power. This high frequency energy is transmitted to an applicator through a wave guide. The applicator is a wave guide element designed to efficiently couple or direct the microwave power or radiant energy into the material to be heated.

Process transducers are conventionally used to measure the microwave field, process rate, and operating temperature. The operating microwave power level is controlled by the control unit thus permitting a constant process through closed loop feedback control. Unlike other forms of heating, microwave energy responds instantaneously to control. This follows since the heat is developed at the molecular level within the material.

The use of microwave energy for producing or inducing of chemical reactions, is well-known. In spite of the extensive research and many studies which have been made, the matter and mechanism by which microwave energy produces a reaction or atomic and molecular change within various materials is not well understood. Heating at the microwave frequency, for example, is used extensively for both domestic and commercial purposes. Microwave energy has been applied in the petroleum industry for fracturing underground geological formations surrounding low yield or depleted oil wells to reduce the resistance to flow of the liquid petroleum through the material surrounding the well bore.

OBJECTS OF THE INVENTION

It is the principal objective of the present invention to provide an improved method and apparatus for producing hydrocarbon liquids and hydrocarbon gases from oil shale for subsequent use as fuels or chemical raw materials. A more specific object of the present invention is to provide an improved process, which may be continuous or discrete in nature, for the production and partial refinement of hydrocarbon liquids, solids and gases from oil shale.

SUMMARY OF THE INVENTION

In accordance with the present invention, microwave energy is utilized, in a closed noncombustion process, to produce hydrocarbon gases, liquids, vapor and gaseous products such as carbon monoxide, and carbon dioxide. In this process, oil shale is preheated, preferably by circulating the hot gas by-products in heat exchange relation to the incoming oil shale, and subjecting the oil shale to microwave energy in a closed configuration which excludes air. The liquid, vapor and gas products, principally hydrocarbons, are collected, condensed and stored. Some of the hot vapor and gases produced may be recirculated to provide a hot gas preheater. A portion of the vapor and gaseous products produced may be withdrawn and stored or utilized for subsequent processes. The processed oil shale may be cooled utilizing conventional heat recovery techniques. The gases produced by this process include combinations of methane, hydrogen, carbon monoxide, and carbon dioxide, as well as some aliphatic gases such as butane, ethane, pentane, and propane. The combined gaseous products, as typically produced, have a heat of combustion in the range of about $1.86\times10^7$ to about $3.72\times10^7$ Joules per cubic meter. The condensed liquid products which are produced possess a relatively high specific gravity, generally in the vicinity of 938 Kgm per cubic meter (API gravity −19). The heat energy of combustion of these condensed liquid products is in the range of about $37.2\times10^6$ to about $41.7\times10^6$ Joules per kilogram.

The oil shale treatment process can either be continuous or discrete in nature. The microwave frequencies currently being utilized are established by law at about $0.915\times10^9$ Hertz or $2.45\times10^9$ Hertz. Other frequencies may prove to be more desirable in that they increase the heating and product recovery efficiency by means of better microwave energy coupling.

DESCRIPTION OF THE PREFERRED EMBODIMENT

Figure 1:
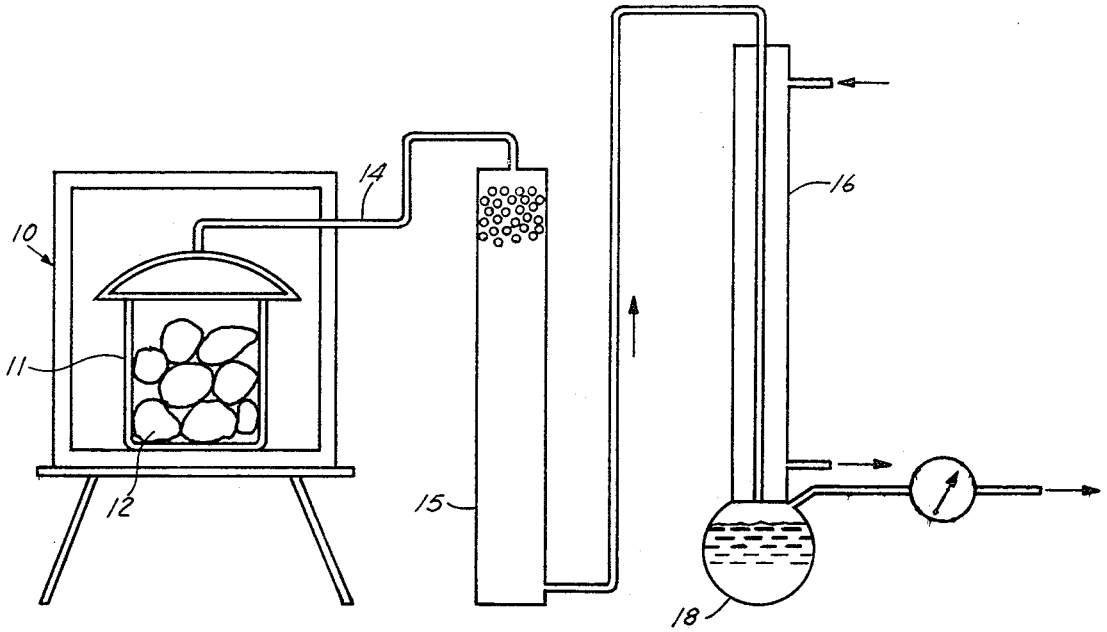
FIG. 1 is a diagrammatic drawing of a batch apparatus embodying the present invention for the microwave processing of oil shale.

One form of apparatus embodying the present invention is shown in FIG. 1, and comprises a small commercial microwave oven 10, rated at 2,450 MHz and 650 watts, modified to fit a quartz, or quartz substitute, beaker 11 for receiving a sample of oil shale 12. The apparatus is gas-tight, and the oil and gas products produced are conducted through high temperature glass tubing conduits 14 to a silica gel, or equivalent, filter 15 and a condenser. The oil products are collected in a reservoir 18, while the gases are collected in suitable collection chambers (not shown).

The oil shale to be processed is desirably provided as a large chunk, 5 to 10 cm or larger. After the oil shale particles or fragments are placed in the quartz vessel 11, the entire system is purged with nitrogen, helium, or other inert gas, to remove any residual oxygen. A moderate vacuum, of a different pressure of about 8,000 to 10,000 Newtons per square meter (60 to 80 mm of Hg) is desirably maintained to prevent contamination of volatile products by air.

Microwave energy is applied to the oil shale ore 12 in the quartz vessel 11, at 2,450 MHz and 650 watts for a period of time sufficient to remove all liquid and volatile materials from the oil shale without carbonizing the shale oil. At the start, after a period of time, depending upon oil shale mass, water vapor condenses, followed by the appearance of major cracks and fractures in the oil shale which generally run parallel to the stratum plane. After the majority of water vapor has condensed, sulfurous gases appear, followed by oil vapors and mists. After processing, the spent shale remains solid, but with much less structural integrity and with serious fracturing along planes parallel to the stratum plane of the original ore, and together with many small cracks which greatly increases the shale porosity. This increase in the oil shale porosity is a major advantage over the conventional thermal heating process.

EXAMPLE NO. 1

An oil shale sample of Rifle, Colorado shale weighing 1.672 kgm and having a specific gravity of 2.32, was placed in a quartz vessel as described above. The unit was sealed and purged with inert gas to remove any residual air or oxygen. A vacuum of 9,000 Newtons per square meter was applied. The oil shale was then subjected to microwave energy at $2.45\times10^9$ Hertz and 650 watts for one hour and 52 minutes. During this period of time a gas output of approximately $118.93\times10^{-3}$ cubic meters was produced, having the following analysis by volume:

$CH_4$—$7.08\times10^{-3}$ cubic meters
$CO$—$26.90\times10^{-3}$ cubic meters
$CO_2$—$51.25\times10^{-3}$ cubic meters
$H_2$—$0.28\times10^{-3}$ cubic meters
$C_2H_6$—$0.57\times10^{-3}$ cubic meters
$C_3H_8$—$0.57\times10^{-3}$ cubic meters
$C_4H_{10}$—$6.51\times10^{-3}$ cubic meters
$C_5H_{12}$—$4.25\times10^{-3}$ cubic meters Liquid hydrocarbon oil products were recovered in the amount of 0.0832 kgm. Water was recovered in the amount of $18\times10^{-6}$ cubic meters. The heating value of oil produced was $4.197\times10^7$ Joules per kilogram. The heating value of the gas produced was approximately $3.5\times10^7$ Joules per cubic meter (940 BTU's/cu. ft.). The lack of carbonization in the spent residue was noted.

EXAMPLE NO. 2

An oil shale sample lump of Rifle, Colorado Scale weighing 0.2002 kgm and having a density of 1.97 was placed in a quartz vessel as described above. The unit was sealed and purged with inert gas to remove any residual air or oxygen. A vacuum of 8,000 Newton per square meter was applied. The oil shale was then subjected to microwave energy at $2.45\times10^{-9}$ Hertz and 650 watts for 42 minutes. During this period of time a gas output of approximately 0.0345 cubic meters was produced, having the following analysis:

$CH_4$—$12.74\times10^{-3}$ cubic meters
$CO$—$6.23\times10^{-3}$ cubic meters
$CO_2$—$5.10\times10^{-3}$ cubic meters
$H_2$—$5.38\times10^{-3}$ cubic meters
$C_2H_6$—$4.53\times10^{-3}$ cubic meters
$C_3H_8$—$1.13\times10^{-3}$ cubic meters
$C_4H_{10}$—$0.28\times10^{-3}$ cubic meters
$C_5H_{12}$—$0.28\times10^{-3}$ cubic meters Liquid hydrocarbon oil products were recovered in the amount of 0.01775 kgm. Water was recovered in the amount of 0.045 kgm. The heating value of the gas produced was approximately $2.42\times10^7$ Joules per cubic meter (650 BTU's/cu. ft.). The lack of coking or carbonization was noted.

EXAMPLE NO. 3

An energy balance calculation was made based on actual laboratory data using a low efficiency (55%), commercial, unregulated microwave oven and a gas/-vapor collection system. The microwave oven was rated at 650 watts microwave input; the actual power input for processing the oil shale sample was 300 watts microwave power. The pertinent data and calculations are presented in Table I.

TABLE I

Oil Content of Oil Shale Sample:
$14.6 \times 10^{-5}$m/Kgm (35 gal/ton)
Oil Shale Sample Mass Used:
0.4536 Kgm (1 lb.)
Electric Power Input to Microwave Oven:
300 watts
Operating Time of Microwave Oven:
1800 seconds (30 minutes)
Electric Energy Input to Microwave Oven:

$$(300 \text{ watts})(1800 \text{ sec.})(1.818 \text{ Joules/watt-sec.})\left(\frac{1}{0.4536 \text{ kgm}}\right) = 2.165 \times 10^6 \text{ Joules/kgm}$$

Energy Equivalent of Product Produced from the Processed Oil Shale:
Oil $3.97 \times 10^6$ Joules/kgm
Gas $3.82 \times 10^6$ Joules/kgm
Total $7.79 \times 10^6$ Joules/kgm
Total Energy Equivalent from Both the Oil and Gas Produced:
$7.79 \times 10^6$ Joules/kgm
Energy Balance Ratio =

$$\frac{\text{Energy Contained by the Produced Product}}{\text{Energy Input}} = \frac{7.79 \times 10^6 \text{ Joules/Kgm}}{2.615 \times 10^6 \text{ Joules/Kgm}} = 3.60$$

From the microwave processing operation, it was observed that between 18% and 20% by mass of gas was recovered, between 3% and 18% by mass oil liquid was recovered, and the balance was process loss and processed shale residue, which was principally inorganic in nature. The gas produced included principally methane, carbon monoxide, carbon dioxide, hydrogen and the aliphatic hydrocarbons such as ethane, butane, propane and pentane, with traces of the higher aliphatic hydrocarbons. The production quantity of gas and liquid products by microwave processing compared favorably with the thermal heating processing of oil shale. The oil or liquid produced from the microwave process was observed to have a lower viscosity, attributed principally to the lower temperature of the materials during the processing. The effective gas and oil production rate from the microwave process was so rapid that any chemical cracking conditions apparently occurred within the kerogen as the oil and gas was produced. It was further observed that the interior of the sample of processed shale residue was substantially devoid of visible carbon. Coking, or carbonization, which is the main degradation mechanism of shale oil from thermal heating processes, was noticeably absent.

Figure 2:
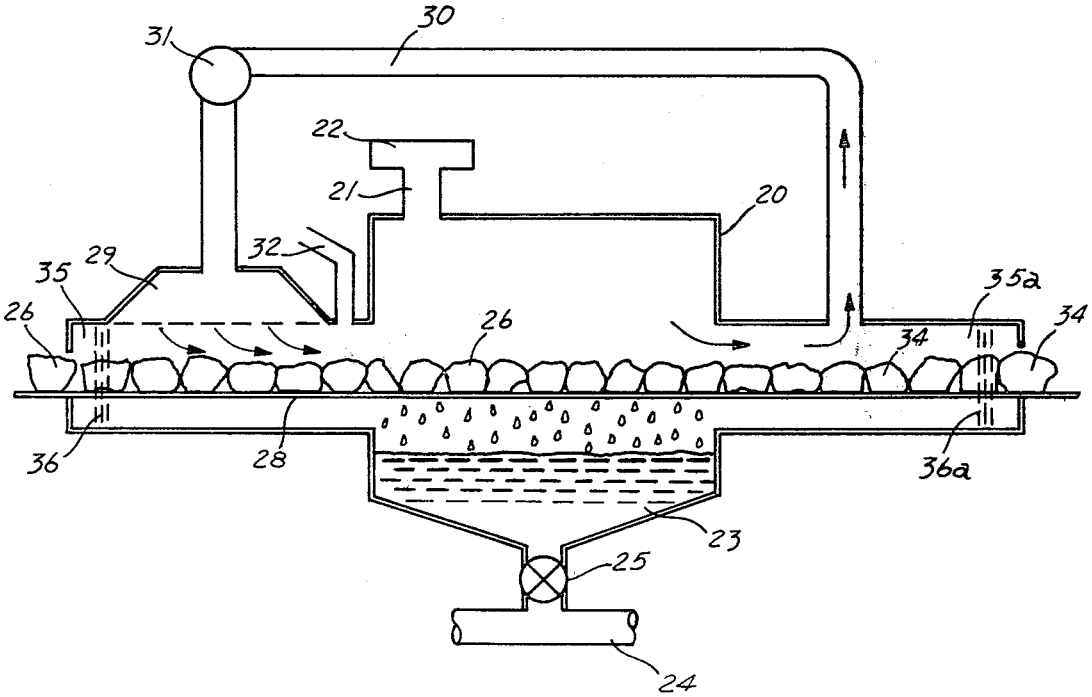
FIG. 2 is a schematic drawing of a continuous apparatus embodying the present invention for the microwave processing of oil shale.

Turning to FIG. 2, there is shown a continuous process for the processing of oil shale with microwave energy. In this process, a vessel or chamber 20 receives microwave energy from microwaves through a wave guide 21 from a microwave transmitter 22. The bottom of the vessel serves as a collection reservoir 23 for liquid oil produced. A discharge conduit 24, which includes an appropriate valve mechanism 25, conducts the liquid oil produced to storage or other processes.

The oil shale is broken into large particles or fragments 26 in any appropriate apparatus (not shown). The fragments generally are between 5 to 10 cm. or larger. The shale fragments are placed on a conveyor 28 and conveyed through a microwave leak suppression tunnel 35 and gas/air seal 36 to the microwave cavity and heating chamber 20. Prior to entrance into the chamber, the conveyor 28 carries the oil shale 26 through a hot-gas preheater 29, which receives hot gases from the microwave cavity and chamber through a conduit 30 and pump 31. The hot-gases directly preheat the large oil shale particles or fragments 26, simultaneously condensing a portion of mists or vapors contained in the gases, and the cooler gases are discharged through an appropriate discharge conduit 32. The condensed liquids are collected in the reservoir 23 in the bottom of the microwave chamber 20.

After treatment with microwave energy, the shale residue 34 remaining on the conveyor 28 is conveyed through a second or outlet microwave leak suppression tunnel **35*a* and gas/air seal 36*a* to a discharge station from which the shale residue may be returned to the mine or utilized for other purposes. The gas/air seals 36 and 36*a* may be formed by jet stream curtains of inert gas to exclude air from the preheater 29 and microwave chamber 20**.

It will be appreciated that a continuous process as shown in FIG. 2 may be utilized directly at a mining site, either above or below ground. Such a location eliminates the need for long distance transportation of both the unprocessed oil shale and the processed shale residue.

The heating of oil shale ore by the use of controlled microwave energy produces in addition to the liquid oil products, a high heating value gas which accounts for approximately 50 percent of the heating value of the kerogen in the oil shale. In microwave processing, combustion air is excluded from the chamber and the gas produced is not diluted by air or combustion gases as in thermal processes and the gas and oil products are therefore of a higher grade.

In the processing of oil shale ore, a vertical kiln may be utilized to provide increased efficiency. A vertical kiln facilitates preheating of the incoming ore, which in turn allows the recovery of a large percentage of the input energy. This invention contemplates the employment of microwave energy to volume heat and to preheat the ore in a vertical kiln in a closed cycle process. To minimize the loss of gases and oil vapors and to prevent microwave radiation leakage, auger type injection and removal grates may be utilized.

Figure 3:
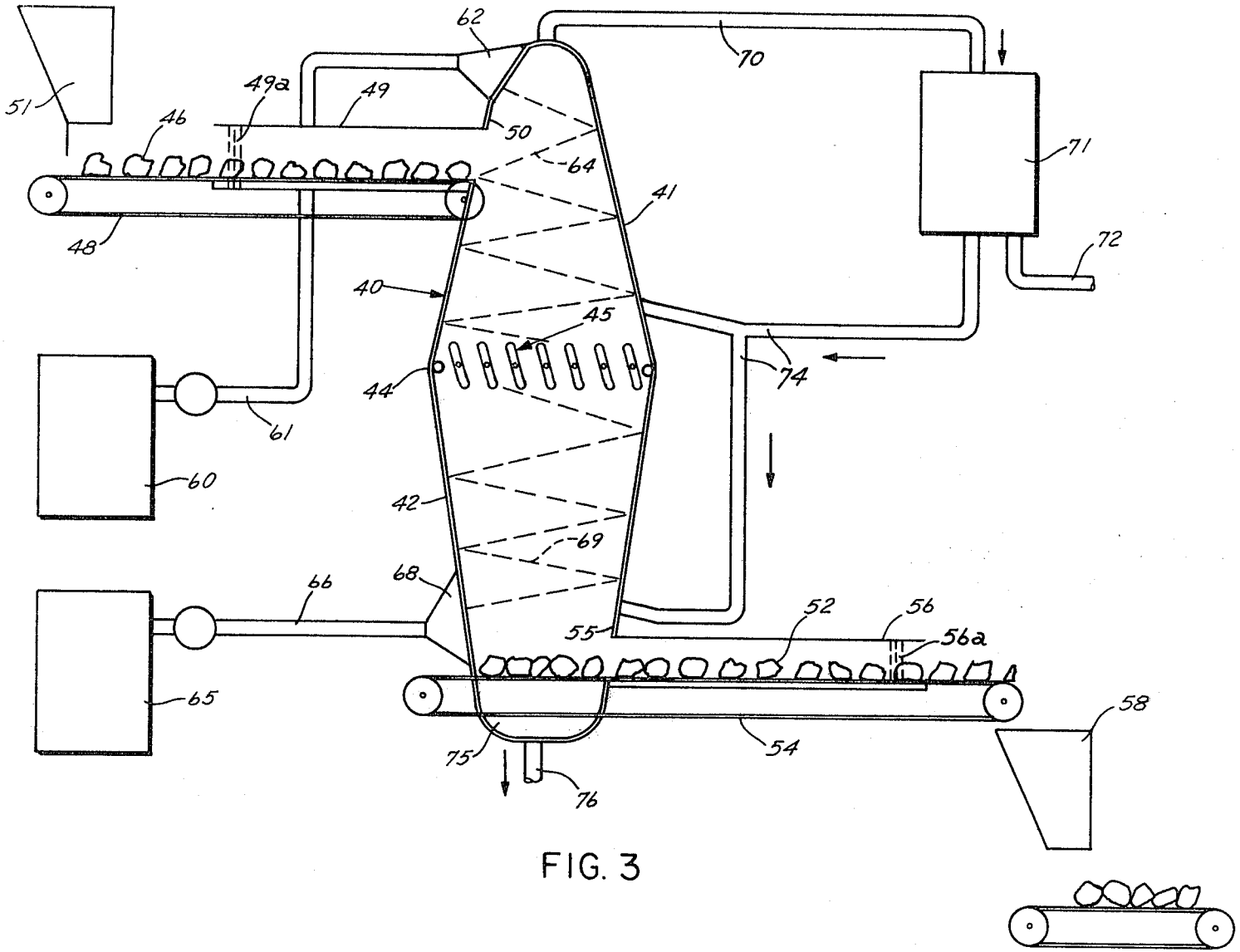
FIG. 3 is a schematic drawing of a vertical kiln and associated apparatus embodying the present invention for the microwave processing of oil shale.

Turning to FIG. 3, there is shown a vertical kiln 40 having a generally double conical shape and forming an upper tapered section 41 and a lower inverted tapered section 42, the sections being adjoining and defining a wider intermediate or transition section 44. For controlling the flow of material through the kiln 40, the kiln is provided with a grate mechanism 45 extending transversely within the kiln in the transition section 44.

Oil shale particles or fragments 46 to be treated in the kiln are fed to the kiln by a conveyor 48 through a microwave suppression tunnel 49 and gas/air seal **49*a* to an inlet opening 50 in the upper portion of the wall of the upper section 41. The shale or other material to be treated in the kiln is broken up by an appropriate apparatus (not shown) and stored in a hopper 51 for controlled discharge onto the conveyor 48. The flow of the oil shale fragments 46 through the kiln are controlled by the grate 45**.

Shale residue fragments 52 are discharged from the bottom of the lower section 42 of the kiln by a discharge conveyor 54 through an opening 55 in the lower kiln wall, and a microwave suppression tunnel 56 and gas-/air seal 56*a*. The shale residue is collected in a hopper 58 or other mechanism for return to the mine or other use.

For treating the oil shale as described above to remove liquid and volatile materials therefrom, the fragments are subjected to microwave energy in both the upper and lower sections 41, 42. To this end, microwave energy is fed from a microwave power unit 60 through a microwave transmitter 61 and horn 62 directed into the upper section 41 at a point adjacent to the apex thereof. Because of the conical or tapered configuration of the upper section of the kiln, the microwaves follow a generally zigzag path 64 downwardly through the upper kiln section 41 towards the transition section 44. The height of the upper section is designed in conjunction with the microwave power unit 60 to provide for optimum utilization of the microwave energy.

The shale fragments in the lower section 42 of the kiln are also treated with microwave energy applied from a second power unit 65 through a microwave transmitter 66 and horn 68 opening into the lower section 42 at a point adjacent to the lower apex thereof. Because of the tapered or conical configuration of the lower section 42, the microwaves follow a generally zigzag path 69 upwardly through the kiln towards the transition section 44. Again, the microwave power unit and kiln configuration are coordinated to provide the optimum use of energy.

As described above, the microwave energy effects the release of hydrocarbon gases, vapors and liquids from the shale. The gases and vapors are carried off of the top of the kiln through a conduit 70 and are collected in a mist separator and vapor condensor 71. High temperature gases are conveyed through appropriate conduits 74 back to the kiln where they are recirculated in order to recover heat energy. The liquids are drawn off through a conduit 72 to storage. Liquids collected in the reservoir 75 in the bottom of the kiln are drawn off through an appropriate liquid outlet 76 and conveyed to storage.

Figure 4:
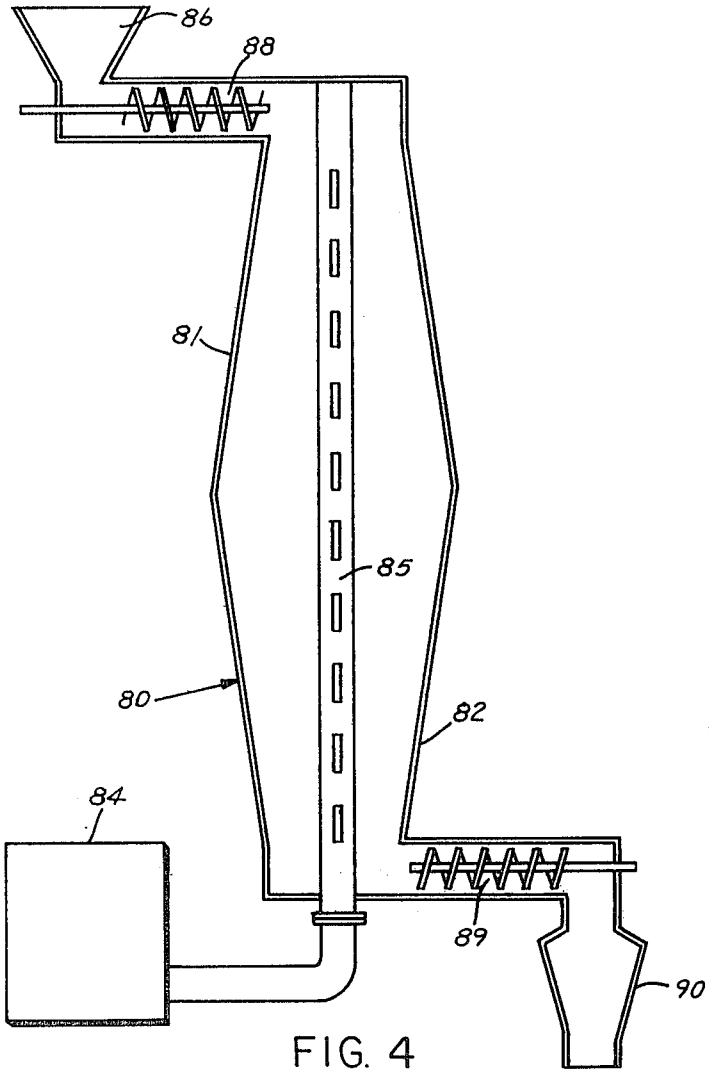
FIG. 4 is a schematic drawing of a vertical kiln and slotted circular wave guide embodying the present invention for the microwave processing of oil shale.

An alternate form of kiln construction is shown in FIG. 4. In this construction, the kiln 80 is likewise formed of upper and lower tapered or conical sections 81, 82 respectively. Microwave power fed to the kiln from a microwave generator 84 through a slotted wave guide or coaxial guide 85 extending axially upwardly through the kiln. Lump fragments of shale or other material to be treated with the microwave energy are fed to the top of the kiln from a hopper 86 by means of an auger conveyor 88. Ash or shale residue products are removed from the bottom of the kiln by an auger conveyor 89 to a collection hopper 90 for appropriate disposal. The auger conveyors are designed to be gas tight to prevent air contamination and loss of volatiles and also as microwave seals. Depending upon the kiln design, the kiln shown in FIG. 4 may be utilized by feeding raw materials in at the bottom and removing ash or spent products from the top. As described in reference to FIG. 3, the kiln likewise includes appropriate gas/air seals, microwave suppression tunnels, mist separators and vapor condensers, liquid reservoirs and the like (not shown).

Figure 5:
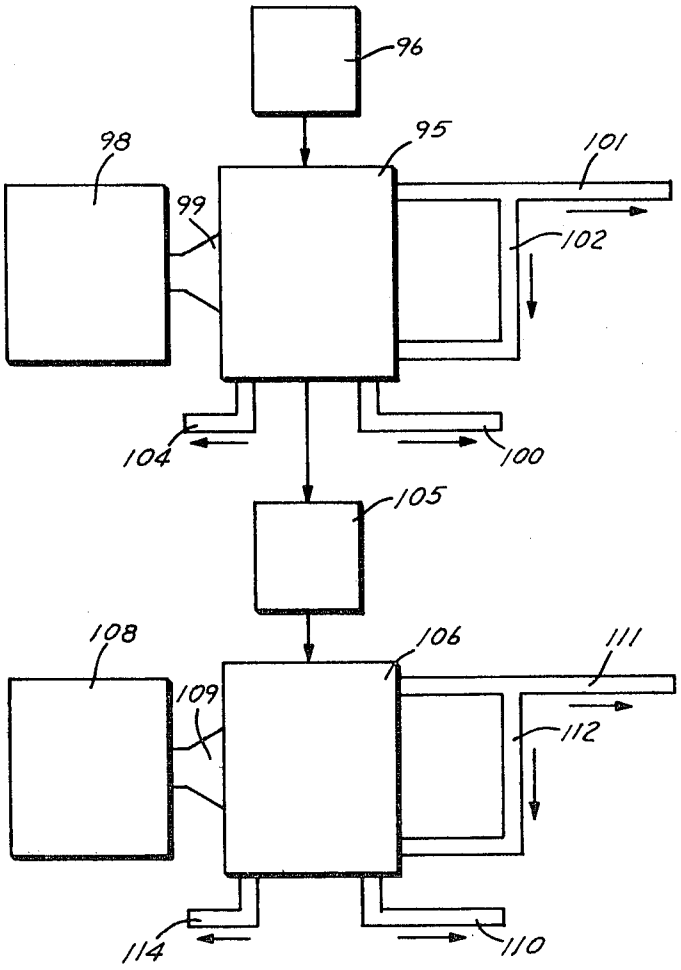
FIG. 5 is a schematic drawing of a multiple kiln process embodying the present invention.

A process for the processing of oil shale is shown diagrammatically in FIG. 5. This process utilizes sequential kilns with an inlet crusher and an intermediate crusher. It has been observed that the reheating of shale ore previously processed by microwaves requires substantially less time and that a secondary recovery can be effected at lower power and higher frequency. In this embodiment of the invention, there is provided a first kiln 95 which receives shale ore fragments broken to a size approximately 5–10 cm or larger by a suitable crushing device 96. In the kiln, the ore is subjected to microwave energy, for example microwaves having a frequency of 915 MHz at 300 kw, by an appropriate microwave generator 98 coupled to the kiln through a horn applicator 99. Liquid shale oil is drawn off from the kiln through a conduit 10 while gases and oil vapors are drawn off through a conduit 101 and a portion of the gas is recycled through a conduit 102. If necessary, residue can be removed through a conduit 104. The first treated shale oil residue is then further reduced in size by an intermediate crusher unit 105, and is fed to a second stage kiln 106 in which the ore is subjected to microwave energy, for example microwaves having a frequency of 2450 MHz, from a microwave generator 108 coupled to the kiln 106 by a horn applicator 109. In the second stage the microwave energy is supplied at a lower power, for example 100 kw, and a higher frequency, for example 2450 MHz. Again, liquid shale oil is drawn off through a conduit 111, with a portion of the gas being recycled to the kiln through a conduit 112. If necessary, residue is drawn off through a conduit 114. As described in reference to FIG. 3, these kilns likewise include gas/air seals, microwave suppression tunnels, mist separators, vapor condensors, and the like (not shown).

For the in situ recovery of shale oil, a plurality of bore holes are drilled into an oil shale formation. Into each is lowered a suitable microwave applicator and power unit. Upon the application of microwave power to the oil shale formation, gases, vapors and liquids are produced and recovered from the bore holes by appropriate pumping condensing and storage equipment. In order to provide the maximum recovery of hydrocarbon products, the holes are so arranged that the microwave fields from the transmitters overlap. The microwave power units, during operation, may be raised or lowered slowly in the holes in order to cover the shale throughout the entire depth of the formation. If desired, the recovery may be carried out in two stages, utilizing a first stage with a high power, low frequency microwave and a second stage utilizing a low power, high frequency microwave. Pulsed microwave power may also be used.

Since air is not admitted into the microwave process system, the formation of combustion gas compounds and residual nitrogen does not occur, which compounds can cause damage to catalysts used in a subsequent refinery phase.

Microwave processing of oil shale further affords a significant increase in the process rate or a decrease in the process through-put time. In microwave processing of oil shale ore, the amount of energy which is converted into heat is a function of the dielectric loss at each point in the ore, the field strength, the size of the ore particles or fragments compared to the wave length, and the heat capacity of the ore. Since larger ore fragments or particles are desirable for good coupling of the microwave energy (e.g. 5–10 cm or greater), the amount of auxiliary power required for ore processing is minimized.

The processing of oil shale ore by the use of controlled microwave energy produces a higher grade of synthetic crude. That is, the microwave volume heating also produces chemical changes which results in a partial refining of the products (e.g. gas and oil). Thus the methods and equipment produces prerefined liquid and gaseous products of higher commercial value. The kerogen is cracked at minimum decomposition temperatures by the use of feedback controlled microwave processing, which produces relatively low molecular weight primary product molecules of sufficient stability which undergo a minimum of polymerization.

Reheating of previously microwave processed ore requires significantly less time. Thus secondary recovery processing by microwave energy is included.

Most oil shale thermal processes require large quantities of water. Water in sufficient quantity is usually in short supply in the vicinity of the shale ore deposits. Microwave processing of oil shale, however, does not require water. Because microwave processing is enhanced in the presence of steam, water or steam injection may be included in the cycle. This will result in a smoother process and in addition will provide some additional hydrogen.

By controlling the microwave field strength or by the use of pulsed power, the process temperature can be limited so as to produce the desired kerogen decomposition and yet minimize endothermal decomposition of the carbonate minerals.

In microwave processing thermal conduction will be increased during the process and preprocess phases of the charge cycle by the circulation of the hot gases and vapors. These gases, vapors, and combustion products will also displace initial or leakage air in the microwave kiln on start up.

For removal of hydrocarbon products from oil shale, discontinuous or pulsed microwave heating is effective. This can be accomplished in several different ways. In the case of pulsed power or variable cycles of on-off power, a heating effect will occur during the on time and a heat-soaking effect will occur during the off time. Continuous wave (CW) power could be employed during preheat (i.e. up to the temperature or onset of polymerization), and pulsed power could be used to maintain the pyrolysis temperature and flow of hydrocarbon products for the balance of the heat process cycle. Two-stage heating is also useful. Microwave heating of shale ore is not uniform because of the nonhomogeneous structure and nature of the shale ore, and the variation of the field intensity within the kiln. This uneven heating develops deep cracks in the shale ore fragments. Two-stage heating would make use of this physical cracking by first heating at a lower frequency and higher power, for example 300 KW at 915 MHz, and then introducing an ore processor unit to complete the grading operation. For increased efficiency in microwave processing, it is desirable to have the dimensions of the broken shale ore fragments or particles greater than 5–10 cm since the insulating property of the shale (marlstone) helps the molecular temperature to rise rapidly. In the second heating stage, since the shale ore fragments are smaller, a higher frequency and a lower power could be used, for example 100 KW at 2450 MHz.

The use of portable microwave generators equipped with full circle, 360 degree, microwave applicators for in situ retorting of oil shale ore is also feasible. These generators and waveguides or coaxial applicators may be inserted into suitably drilled holes in the oil shale. The microwave energy will penetrate the oil shale causing internal volume heating, which decomposes the kerogen resulting in a release of the gaseous and liquid hydrocarbons. The volume and radial distance heated is dependent on the level of power used. Voids and cracks are produced in the oil shale as the kerogen decomposes and volatilizes. These voids and cracks provide increased porosity in the previously impermeable shale, which facilitates the release of the hydrocarbon products. Furthermore, the voids and cracks within the oil shale also provide a progressive mechanism for deeper penetration of the microwave field.

Since sulfurous compounds are released with the gaseous compounds produced in the process, the microwave process is useful for the desulfurization of oil shales.

While certain illustrative embodiments of the present invention have been shown in the drawings and described above in considerable detail, it should be understood that there is no intention to limit the invention to the specific forms disclosed. On the contrary, the intention is to cover all modifications, alternative constructions and processes, equivalents and uses falling within the spirit and scope of the invention as expressed in the appended claims.

What is claimed is:

1. Apparatus for producing liquid and gaseous hydrocarbons from oil shale fragments comprising, in combination, a vertical kiln closed to the admission of air and composed of upper and lower sections, each of which is tapered in configuration from a relatively narrower end to a relatively wider end, the wider end portions of said sections being joined together by an intermediate transition section, a control grate positioned in said transition section for controlling the flow of the shale fragments through the kiln, means including a conveyor extending through a microwave suppression tunnel and gas seal into the upper section of the kiln for introducing oil shale fragments into said upper section, means including a conveyor through a microwave suppression tunnel and gas seal extending from the bottom of the lower section of the kiln for discharging processed oil shale fragments from the bottom of the lower section of the kiln, means for applying microwave energy to the upper and lower sections of said kiln adjacent to the narrow ends thereof, and means for collecting liquid and gaseous products produced in the kiln from the oil shale by the application of said microwave energy.

2. Apparatus for producing liquid and gaseous hydrocarbons from oil shale fragments comprising, in combination, a vertical kiln closed to the admission of air and composed of upper and lower sections, each of which is generally conical in configuration with the wider portions of said section being joined together by an intermediate transition section, a fragment control grate positioned in said transition section, means for introducing oil shale into the top of the upper section of the kiln, means for discharging spent shale from the bottom of the lower section of the kiln, means for applying microwave power to the upper and lower sections of said kiln, and means for collecting liquid and gaseous products produced in the kiln from the oil shale by the application of said microwave energy thereto.

3. A process for producing liquid and gaseous hydrocarbons from oil shale comprising the steps of breaking the oil shale into fragments, subjecting said fragments to microwave energy in the absence of air and at an energy level and for a period of time sufficient to separate at least a portion of the liquid and gaseous hydrocarbons thereform, further breaking up said partially treated fragments of oil shale into smaller fragments, and further subjecting said smaller fragments to microwave energy in the absence of air and at an energy level and for a period of time sufficient to separate substantially all the remaining recoverable liquid and gaseous hydrocarbons from said oil shale.

4. A process for producing liquid and gaseous hydrocarbons from oil shale as defined in claim 3, including the step of preheating the oil shale by heat exchange contact with the gaseous hydrocarbons produced as a result of the application of microwave energy thereto.

5. A process for producing liquid and gaseous hydrocarbons form oil shale as defined in claim 3, including the step of injecting water or steam during the microwave heating thereof.

6. A process for producing liquid and gaseous hydrocarbons from oil shale as defined in claim 3 wherein said oil shale is subjected to pulses of microwave energy.

7. A process for producing liquid and gaseous hydrocarbons from oil shale as defined in claim 3 wherein said oil shale is subjected to microwave energy in two stages, wherein the first stage is at a lower frequency and a higher power than the second stage.

* * * * *